US009267306B2

(12) United States Patent
Suhami

(10) Patent No.: US 9,267,306 B2
(45) Date of Patent: Feb. 23, 2016

(54) MULTI-STOREY BUILDINGS BUILT OVER ROAD AIR-SPACES

(71) Applicant: Avraham Suhami, Petah Tikva (IL)

(72) Inventor: Avraham Suhami, Petah Tikva (IL)

( * ) Notice: Subject to any disclaimer, the term of this patent is extended or adjusted under 35 U.S.C. 154(b) by 0 days.

(21) Appl. No.: 13/958,564

(22) Filed: Aug. 4, 2013

(65) Prior Publication Data

US 2015/0033647 A1 Feb. 5, 2015

(51) Int. Cl.

| | |
|---|---|
| ***E01C 1/02*** | (2006.01) |
| ***E04H 6/10*** | (2006.01) |
| ***E04H 14/00*** | (2006.01) |
| ***E04B 1/34*** | (2006.01) |
| ***E04H 1/04*** | (2006.01) |
| *E01C 1/00* | (2006.01) |

(52) U.S. Cl.

CPC .. *E04H 6/10* (2013.01); *E04B 1/34* (2013.01); *E04H 1/04* (2013.01); *E04H 14/00* (2013.01); *E01C 1/002* (2013.01); *E01C 1/02* (2013.01)

(58) Field of Classification Search

CPC ..... E04H 6/10; E04H 14/00; E04H 1/04; E01C 1/02; E01C 1/002

USPC ..... 52/175, 174, 234, 236.6, 236.9, 169.2; 404/1

See application file for complete search history.

(56) References Cited

U.S. PATENT DOCUMENTS

| | | | | | |
|---|---|---|---|---|---|
| 372,549 | A | * | 11/1887 | McDonald | 52/30 |
| 1,340,325 | A | * | 5/1920 | Caulkins | 244/114 R |
| 1,628,934 | A | * | 5/1927 | Turner et al. | 104/27 |
| 1,628,935 | A | * | 5/1927 | Turner et al. | 104/27 |
| 1,661,490 | A | * | 3/1928 | Mihaliak | 104/28 |
| 1,694,383 | A | * | 12/1928 | Heitciken | 104/27 |
| 1,706,496 | A | * | 3/1929 | Pieri | 52/169.3 |
| 1,784,728 | A | * | 12/1930 | Harriss | 404/1 |
| 1,830,518 | A | * | 11/1931 | Mason | 52/176 |
| 3,256,651 | A | * | 6/1966 | Kallman | 52/73 |
| 3,319,385 | A | * | 5/1967 | Szpytman | 52/169.2 |
| 3,675,584 | A | * | 7/1972 | Hall | 104/28 |
| 3,721,056 | A | * | 3/1973 | Toan | 52/236.6 |
| 3,897,662 | A | * | 8/1975 | Fencl | 52/79.2 |
| 5,177,913 | A | * | 1/1993 | Erel | 52/79.1 |
| 5,749,186 | A | * | 5/1998 | Kaufman et al. | 52/236.3 |
| 5,807,020 | A | * | 9/1998 | Chen | 404/1 |
| 7,784,228 | B2 | * | 8/2010 | Gustafson | 52/176 |
| 8,402,698 | B1 | * | 3/2013 | Wang | 52/30 |
| 8,915,669 | B1 | * | 12/2014 | Gustafson et al. | 404/1 |

(Continued)

FOREIGN PATENT DOCUMENTS

| | | | |
|---|---|---|---|
| FR | 2127067 AS | * | 2/1974 |
| JP | 02027065 A | * | 1/1990 |

*Primary Examiner* — Brian Glessner
*Assistant Examiner* — Babajide Demuren

(57) ABSTRACT

The invention discloses multi-storey building structures of different sizes and purposes, built on long-span beams laid on cornerstones of minimal dimensions, on the opposite sidewalks of streets and the medians separating street lanes. Such buildings basically occupy the air-space above streets and roads and may be used for parking garages, residential, office and commercial space or for an optimal combination of them. Parking garages built on the air-space above intersections of roads may enable entry from any direction and exit to a different one, with or without parking and greatly contribute to the rationalization of car traffic in modern mega-cities. Such multi-storey buildings comprising in addition to parking garages, office, residential and commercial space, may save valuable timing wasted in going from one place to another.

6 Claims, 12 Drawing Sheets

(56) References Cited

U.S. PATENT DOCUMENTS

2002/0073637 A1* 6/2002 Stewart et al. ..... 52/236.3
2003/0005653 A1* 1/2003 Sataka ..... 52/236.3
2009/0113821 A1* 5/2009 Guo ..... 52/173.1
2009/0151280 A1* 6/2009 Jones et al. ..... 52/236.3

* cited by examiner

MULTI-STOREY BUILDINGS BUILT OVER ROAD AIR-SPACES

FIELD OF THE INVENTION

This invention relates to buildings structure.

BACKGROUND

Multi-storey buildings across roads have been built; however each of the structures built on each side of the road are of substantial size as is the middle structure bridging the two side buildings that is over the road. The middle building mainly serves as a passageway to connect the two side buildings, while the offices and parking garages are on the side buildings.

To the best of our knowledge there are no multi-storey buildings, built on columns situated either on the edge of sidewalks, on the medians separating driving lanes or both.

Autonomous driverless vehicles have been proposed and some have been tested on the roads. However the design goal of these autonomous vehicles is to replace the human driver on the road; as such they include sensors to image and check the surroundings around the vehicle and a controller to quickly react to changes and adapt the speed, steering and brakes of the vehicle.

The general purpose autonomous vehicle has to respond to the plethora of situations that a human driver may encounter during extended driving, even when the odds of such situations are very small.

Our purpose in automated driverless parking is much limited, it is driving for several minutes at very low speed along a predetermined route, at low and steady speed and have a very high maneuvering capabilities, that enable parking in minimal spaces.

SUMMARY OF THE INVENTION

The invention describes the building of multi-storey parking garages, residential and office buildings or a combination thereof, on the air-space above streets and roads, on long-span beams laid on cornerstone foundation supports of minimal cross-sections, on the opposite sidewalks of said streets and/or the medians separating street lanes.

In the case of a structure built on the air-space above an intersection of roads, the cornerstone foundation supports of minimal cross-sections, may be placed at the corner edges of the sidewalks around the intersection and/or at a median separating lanes. When the span between the sidewalk cornerstone foundation supports is large, an additional support column placed in the middle of the intersection helps support the structure. Consecutive floors of the structure are built in the same manner by laying large span steel beams, with or without concrete, so as to optimize the strength, flexibility and compression of the floor, depending its usage.

The cornerstone foundation supports may be linked by a reinforced concrete layer under the intersection roads, thus reinforcing the integrity of the building. Support columns situated on the medians between lanes may also be used to support the structure on the air-space.

Such buildings are advantageous mainly in mid-cities where real-estate land is practically unavailable or extremely expensive.

Parking garages built on road intersections serve to alleviate the need for parking spaces that are extremely scarce in mid-cities and also alleviate traffic bottlenecks on road intersections.

Such parking garage structures allow access from all directions and exits onto different directions, after parking or without it, while leaving at least one lane for pass-through crossing the intersection. The over the air-space parking garage also duplicates what the traffic lights do and consequently may in some cases eliminate the need for traffic lights at the intersection. An intersection with traffic lights may be converted onto a roundabout without traffic lights. Multi-storey parking garages may specifically be adapted to autonomous driverless vehicles as the route in the garage, to a preassigned parking place is well determined in advance, with no need for maneuvering the car, that requires human decisions. A highly maneuverable robotic trolley may carry the vehicle, to its parking place and back, thus relieving the human driver of the chore to park his car. Sensors pre-installed in the multi-storey garage supplement the capabilities of the robotic trolley and enable to safely bring the vehicle into its designated place, which may be reserved in advance, through the internet.

DETAILED DESCRIPTION OF THE PREFERRED EMBODIMENTS

Figure 1:
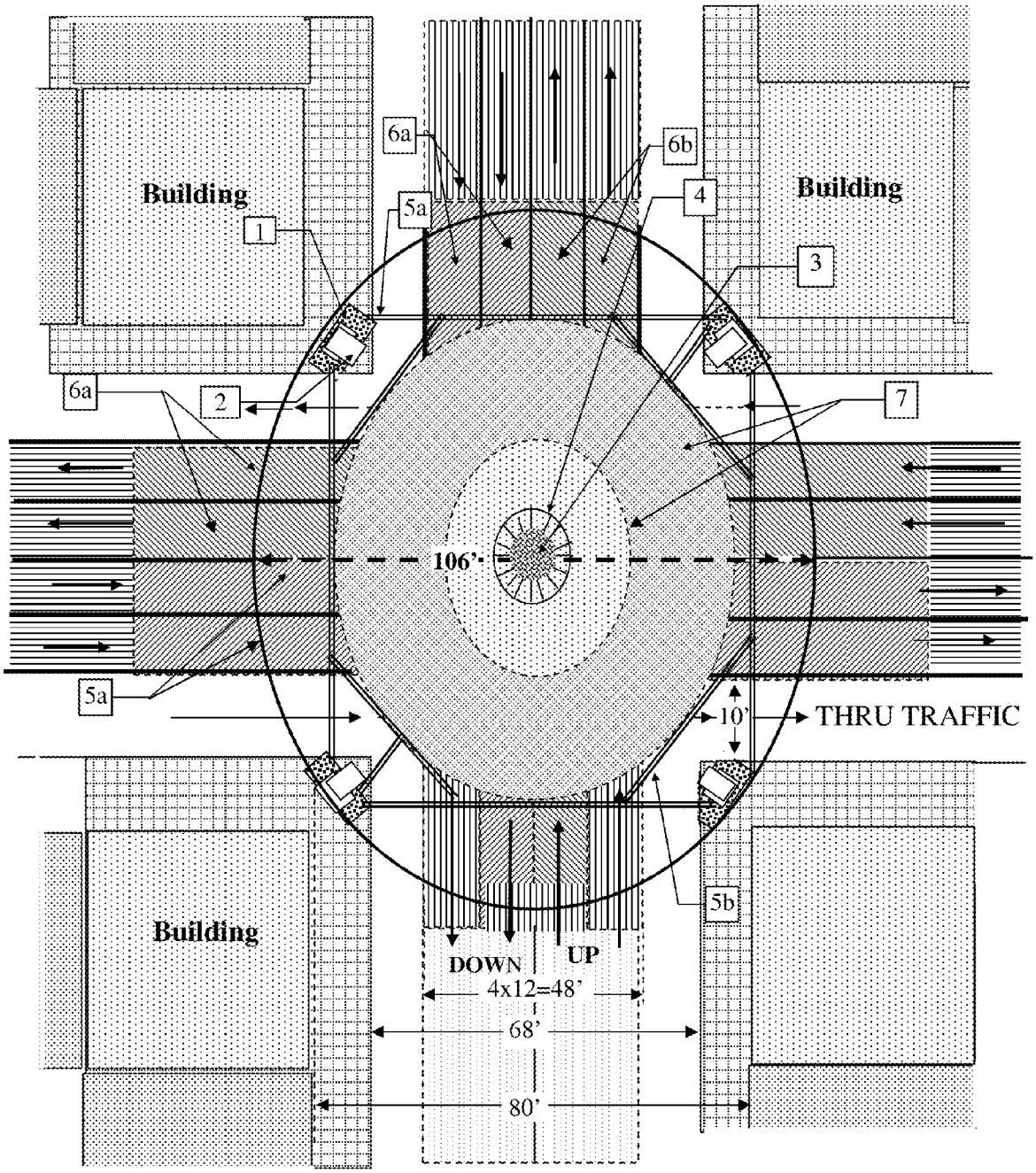
FIG. 1 illustrates a multi-storey building erected on 4 cornerstone foundation supports situated on the 4 sidewalks of the street intersections and a central support column.

FIG. 1 illustrates the view from the top of a multi-storey building of 106 feet diameter erected on 4 cornerstone foundation support 1 situated on the 4 sidewalks of the streets intersection and a central support column 3. The streets have 3 lanes in each direction and 2 of them feature ramps leading to the building, while the 3$^{rd}$ one enables to pass through under the building and either continue on the same direction or turn right/left or back onto one of the other streets. The traffic under the building may be a free square or controlled by lights.

Up and down ramps 5*a*, 6*a*, enable vehicles to reach the first floor of the building from all four directions and from there take the ramps that lead to the upper parking floors.

The floors of the building rising on the air-space above the intersection, are supported on long-span steel beams 5*a*, 5*b* supported by the cornerstone columns of minimal cross-sections. The cornerstone columns may be built of steel and concrete and comprise in their structure, elevators 2 including their mechanical and electrical mechanisms that enable to reach all floors from the street level.

The central section of the building 7 is devoted to up and down ramps for driving cars, while car parking in parking garage floors is reserved on the periphery.

Access to the floors is through elevators 2 adjacent to the cornerstone columns 1. Emergency downstairs are located in the middle 4 of each floor.

The building when used as a parking garage can provide approximately 50 parking places as explained below in connection with FIG. 4.

Figure 2:
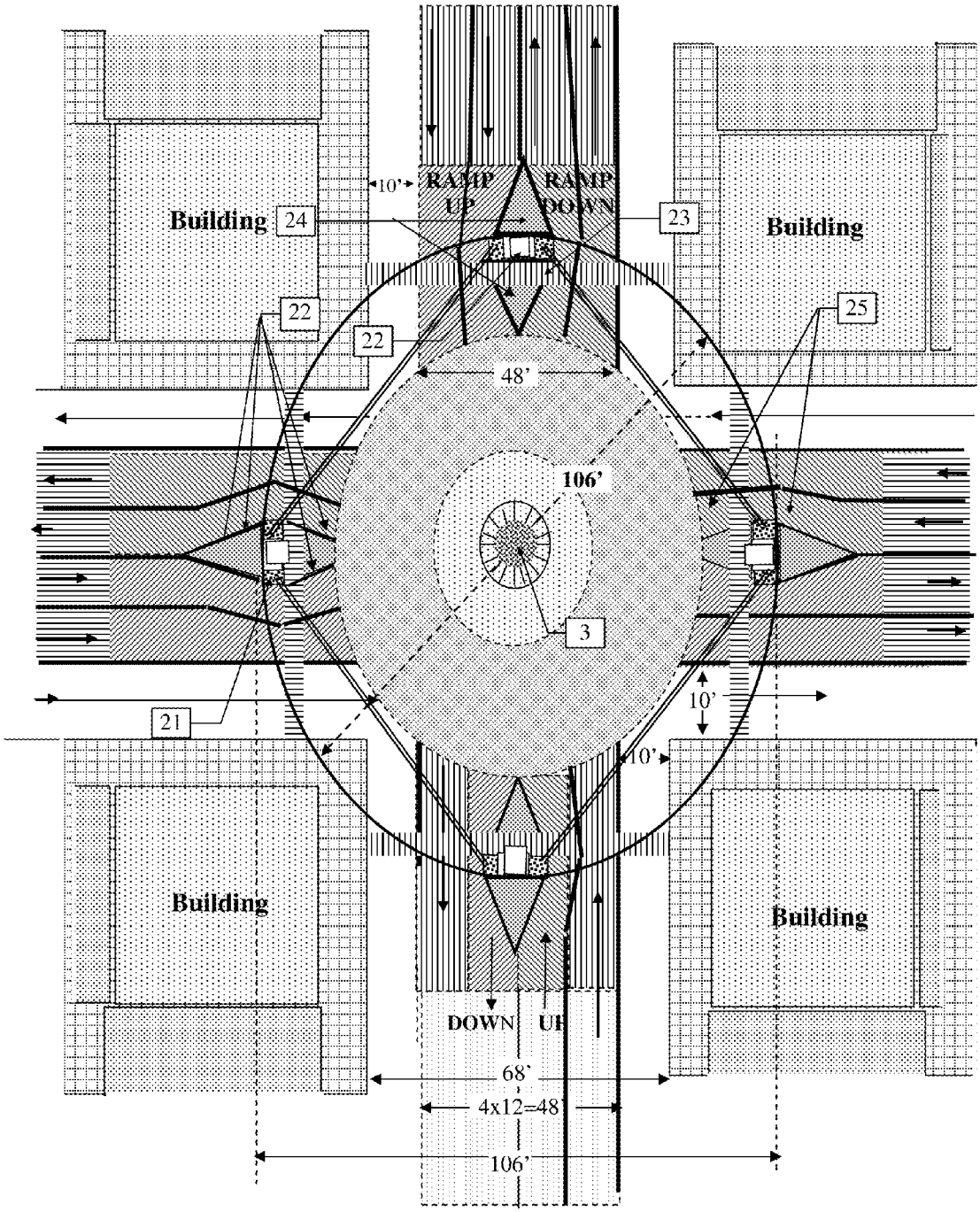
FIG. 2 illustrates a multi-storey building erected on 4 cornerstone foundation supports each situated on the medians of the lanes of intersecting streets and a central support column.

FIG. 2 illustrates a multi-storey building erected on 4 cornerstone foundation supports 21 each situated on the medians of the lanes of intersecting streets and a central support column 3 in the middle of the intersection. In this case, the elevators 22 encompassed in the cornerstone foundation supports, are reached through the pedestrian crosswalks 23. Consequently triangular barriers 24 are placed in front and behind the cornerstone foundation supports housing the elevators and the paths of the up and down ramps 25 to reach the elevated building, have to be changed circumvent the obstacles.

Figure 3:
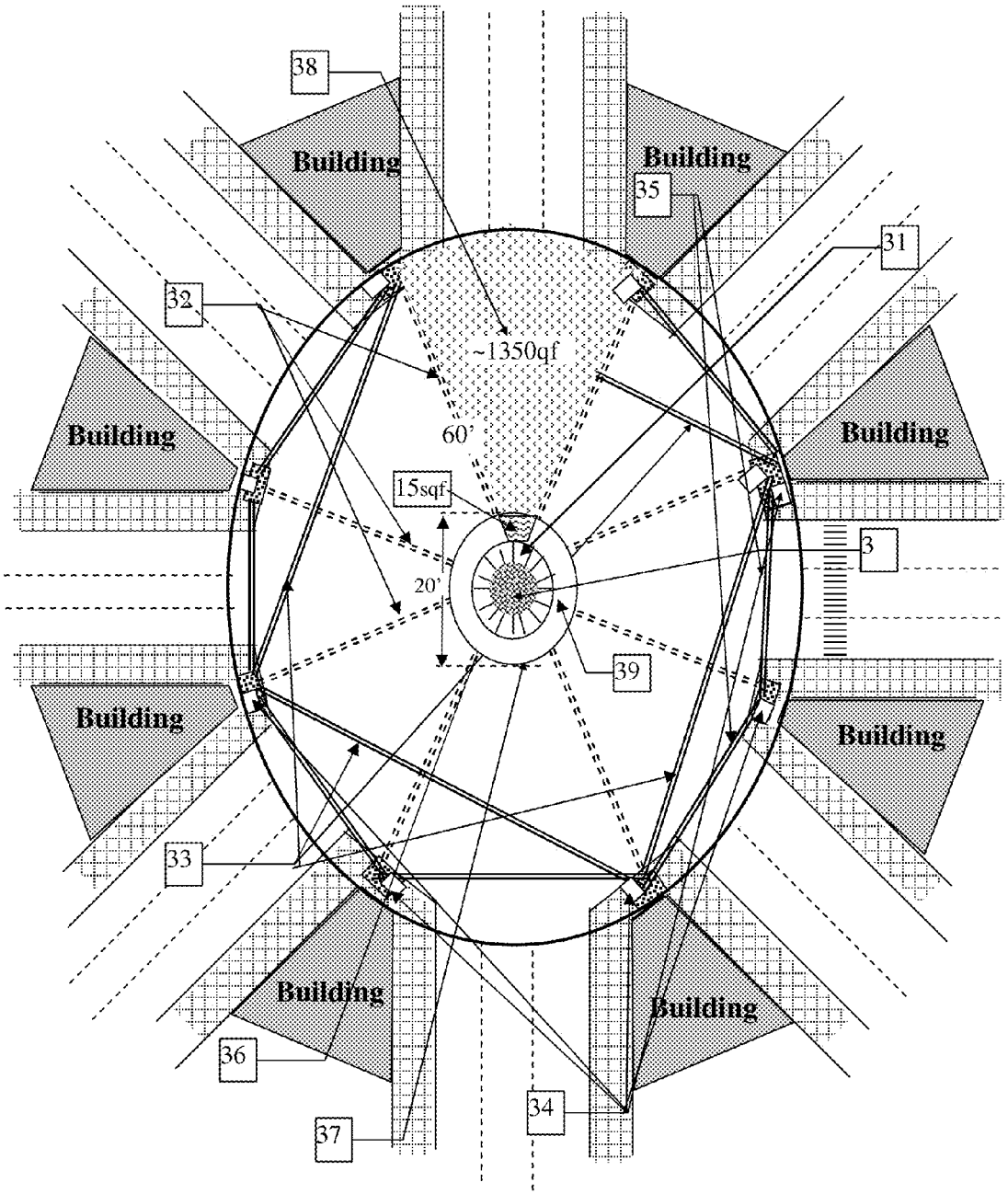
FIG. 3 illustrates a multi-storey building erected on 8 cornerstone foundation supports situated on the 8 sidewalks adjacent to 8 streets leading to a central octagonal roundabout and a supporting column in the centre of the roundabout

FIG. 3 illustrates a multi-storey residential building erected on 8 cornerstone foundation supports situated on the 8 sidewalks adjacent to the 8 streets leading to a central octagonal roundabout, and a supporting column in the centre of said roundabout. Long span beams laid on pairs of cornerstone columns 32, 33, 35 may support the octagonal shaped building. Around the central column 3 are emergency downstair escalators 36, while the elevators 34 adjacent to the cornerstone foundation supports enable access to every floor. Assuming 120' diameter of the building, each floor has an area of 11,306 sq ft or after deducting the 20' diameter central area and the area occupied by the elevators an area of 10,672 sq ft.; if divided into 8 residential apartments, this constitutes this comes to 1334 sq ft per apartment.

Figure 4:
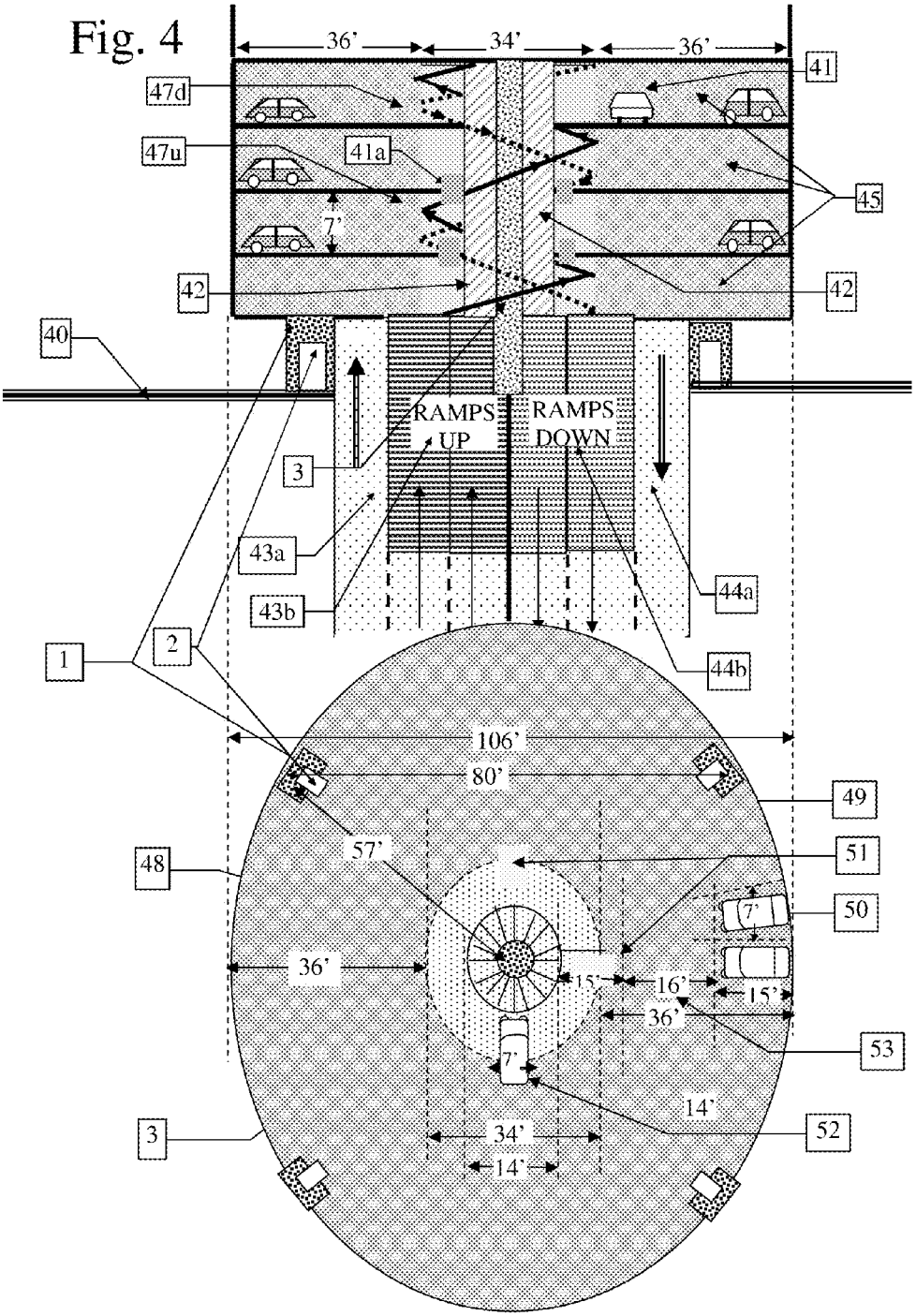
FIG. 4 illustrates side and top views of a multi-storey parking garage supported by columns erected on the intersection of streets, each street with 3 driving lanes in each direction.

FIG. 4 illustrates side and top views of a parking garage floors built on cornerstones 1, situated on the sidewalks 40 of 4 streets forming an intersection, and a column 3 in the middle of said intersection. In this illustration, the distance between the cornerstone posts on which long-span beams that support the structure are laid, is 80' and the distance between a cornerstone post and the central column is 57'. In this illustration, each street has 3 driving lanes in each direction; the lanes close to the sidewalk 43*a*, 44*a* are used to traverse the intersection under the building, while the other 2 lanes in each direction have ramps up to 43*b* and down from 44*b* the parking garage. The illustrated parking garage building has a diameter of 106'; the central 34' diameter section 41 has at its center the 6' wide column that supports the beams holding the structure. Around the central column 3 are 4' wide downstairs 42, on a diameter of 14'. Around the stairs are two counter-spiraling, 10' wide ramps on an outer perimeter of 34' diameter, that assuming traveling in the middle of the ramp, constitutes a 9% inclination. This leaves for a doughnut shaped parking area 49, with an outer diameter of 106' and inner diameter of 34', although some additional parking area is available on the inner section, between entry and exit sections 51 of the spiraling ramps. Cars may be parked along the outer periphery at 8' distance by width one from the other 50; taking in account the width of the 4 columns housing the elevators (4×6') this mode allows 35 parking spots. Parking along the inner area, around the 14' diameter column housing the stairs, requires leaving 2 exit spaces for the cars entering and exiting the ramps. Parking lengthwise every 8' around the 34' diameter periphery, while leaving 2 exit spaces for the cars to enter and exit the ramps, allows 13 additional parking places. This geometry leaves a 16' wide corridor 53 for maneuvering the parking cars. Thus around 48-50 cars can be parked in every floor.

The location of the car ramps between the floors might also be different than the one illustrated; for example the up and down ramps may be located on the periphery of the building or one ramp on the periphery and the other on the center of the buildings. Obviously the stairs too may be located on different parts of the floor.

Figure 5:
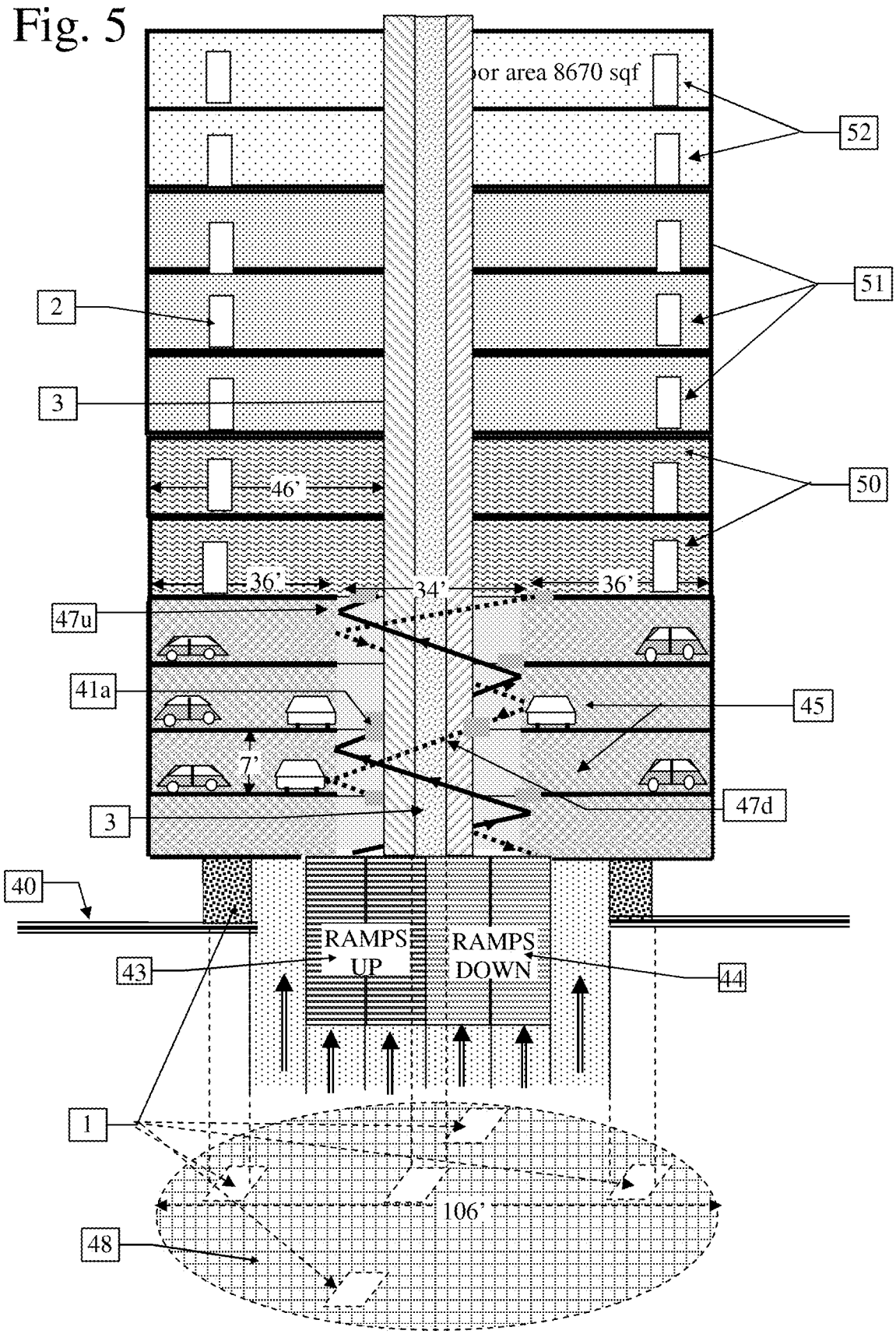
FIG. 5 illustrates a side view of a multi-storey building built on cornerstone foundation supports situated on the corners of sidewalks and linked by reinforced concrete under the roads. It also illustrates the division of the building between a parking garage, commercial. office and residential floors

FIG. 5 illustrates a side view of the multi-storey building standing on cornerstone foundation supports 1 and a central column 3. To improve the stability of tall buildings, the 4 cornerstone foundation supports may be linked to an under-the-streets platform of steel and concrete 48.

The efficiency of the multi-storey building is enhanced by including in the same building, above the parking garage floors, also commercial 50, office 51 and residential floors 52, in this order. Thus for example a resident of the upper floors may have an office in one of the office floors beneath the residential floors, attend some of the shops in the commercial floors and have his car parked in the parking garage of the building.

Figure 6:
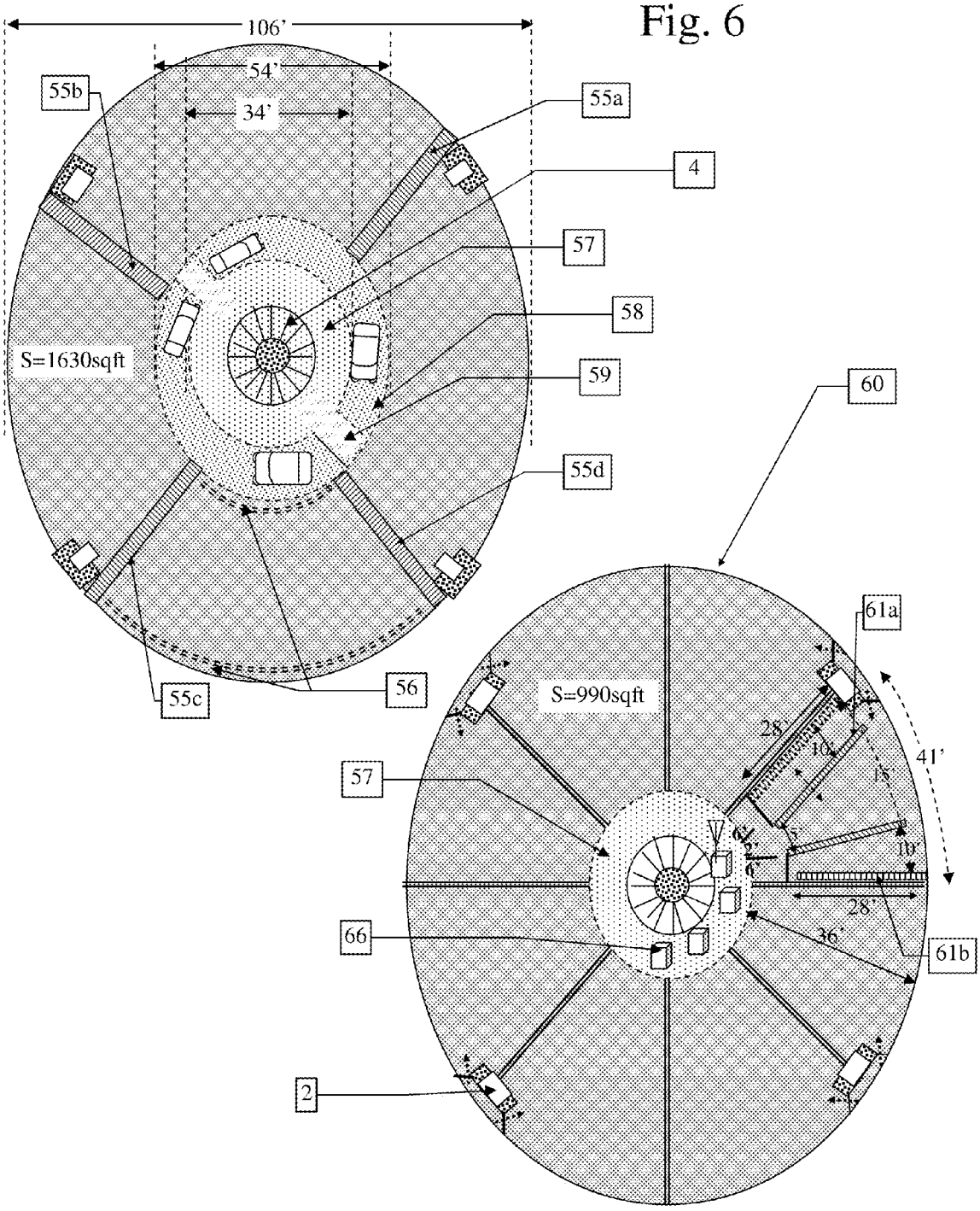
FIG. 6 illustrates the different possibilities of partitioning the floors of the building, by combining a parking garage on the same floor with a residential area, forming residential areas of different sizes with movable flexible partitions or dividing the floor into 8 micro-apartments that are one big living room at day and 3 bedrooms at night.

FIG. 6 illustrates a possible combination of a residential area in a multi-storey building standing on cornerstone foundation supports and a central column as illustrated in FIG. 5, with a connected parking garage 58 on the same floor. The parking garage adjacent to the residential area has direct access 59 to the up and down ramps 57 and thus saves time, when coming in and going out of the apartment. The remaining total floor area of 6534 sq ft may be divided into 4 residential apartments of 1630 sq ft each or furnished with movable partitions, 55*a*, 55*b*, 55*c*, 55*d* on rails 56 that enable flexible living room sizes, depending on the circumstances. The flexible partitions may also serve both as bookshelves and for storage of foldable furniture as explained below in paragraph 14 and illustrated in FIG. 11.

The floor area 60 outside the car ramps 57 totaling an area of 8825 sq ft may also be divided into 8 apartments 990 sq. ft each. The apartments may have movable internal partitions 61*a*, 61*b* on rails that when moved away from the back walls, for example for 10 ft, form 280 sq ft. rooms. The bookshelf like partitions may store foldable beds, chests, tables and chairs, that when unfolded turn these rooms into bedrooms at night.

Figure 7:
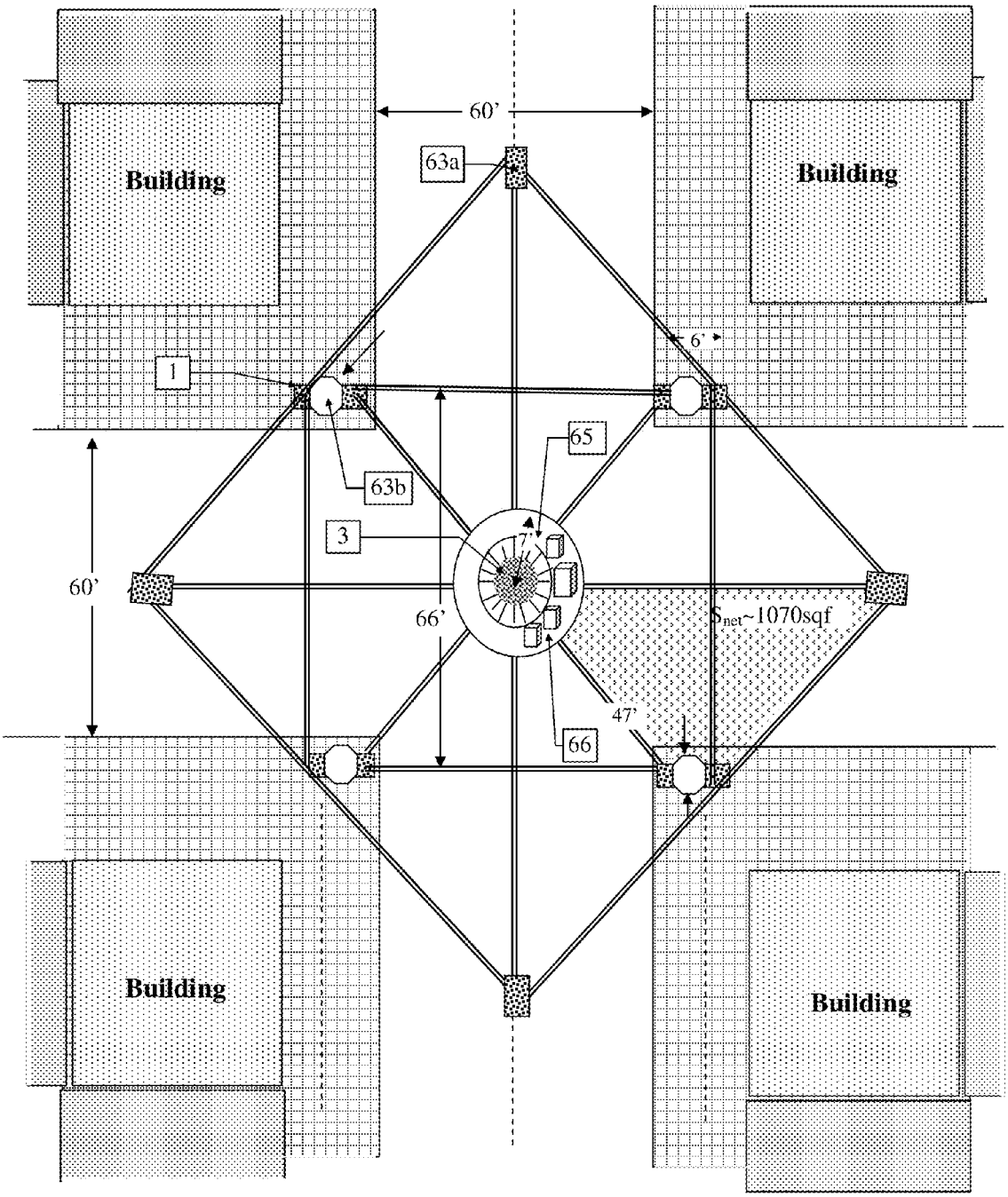
FIG. 7 illustrates a top view of a multi-storey residential or office building built on 4 cornerstone foundation supports situated on the 4 sidewalks adjacent to the intersecting streets and four columns situated on the medians of the streets separating the lanes and a support column at the center of the intersection. It also illustrates its division into 8 micro-apartments.
Figure 10:
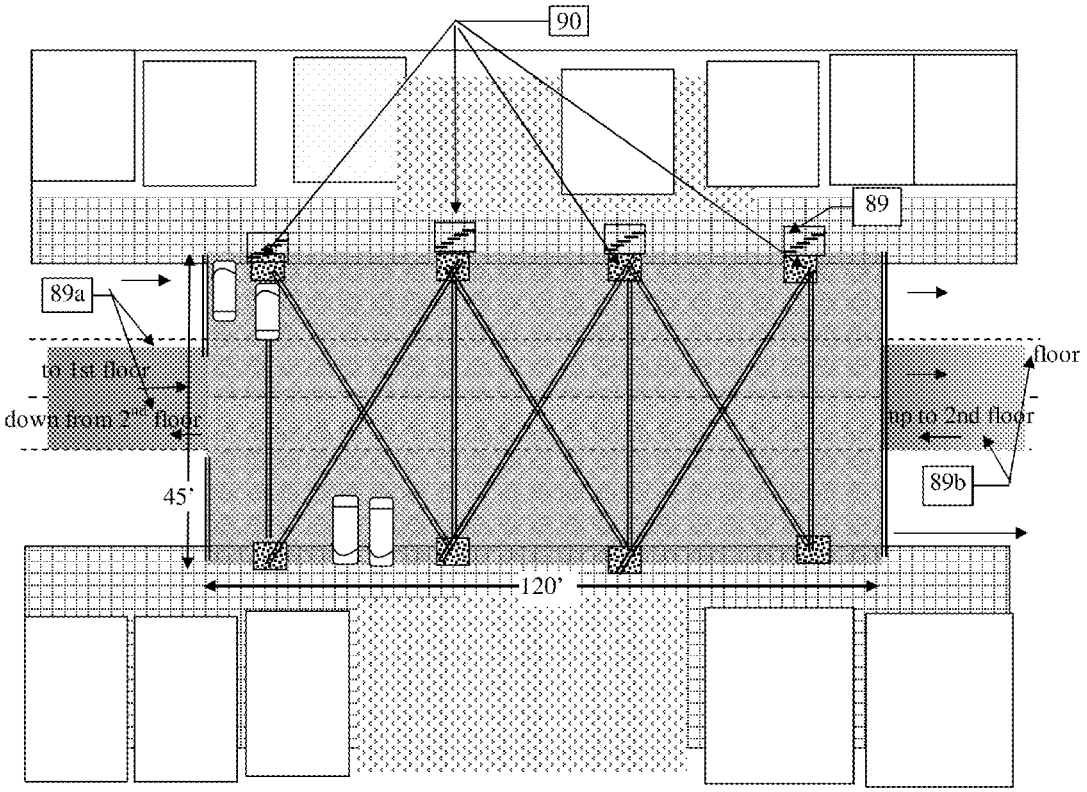
FIG. 10 illustrates a 2 storey car garage built on columns situated on the medians of a 4 lane street that can accommodate 80 cars.

FIG. 7 illustrates a top view of a multi-storey residential or office building built on 4 cornerstone foundation supports 1 situated on the 4 sidewalks adjacent to the intersecting streets and four columns 63*a* situated on the medians of the streets separating the lanes and a support column 3 at the center of the intersection. The cornerstone rectangular columns also comprise elevators 63*b* that can be accessed and exited from 2 directions. The illustrated streets in this case are 60' wide, narrower than the exemplary 80' wide streets shown in FIGS. 1 and 2. In this case having support columns 64 on the medians of streets allows the use of shorter beams to support the building standing in the air-space above the intersection. Nonetheless each floor, in this case may accommodate 8 apartments or offices of approximately 1070 sq ft each. In this architecture, some common appliances like washing and drying machines airconditioning and a network communication server 66 may be shared and located in a common space 65 outside the apartment/office. The building does not comprise parking places. A simple parking garage of two floors is illustrated in FIG. 10.

Figure 8:
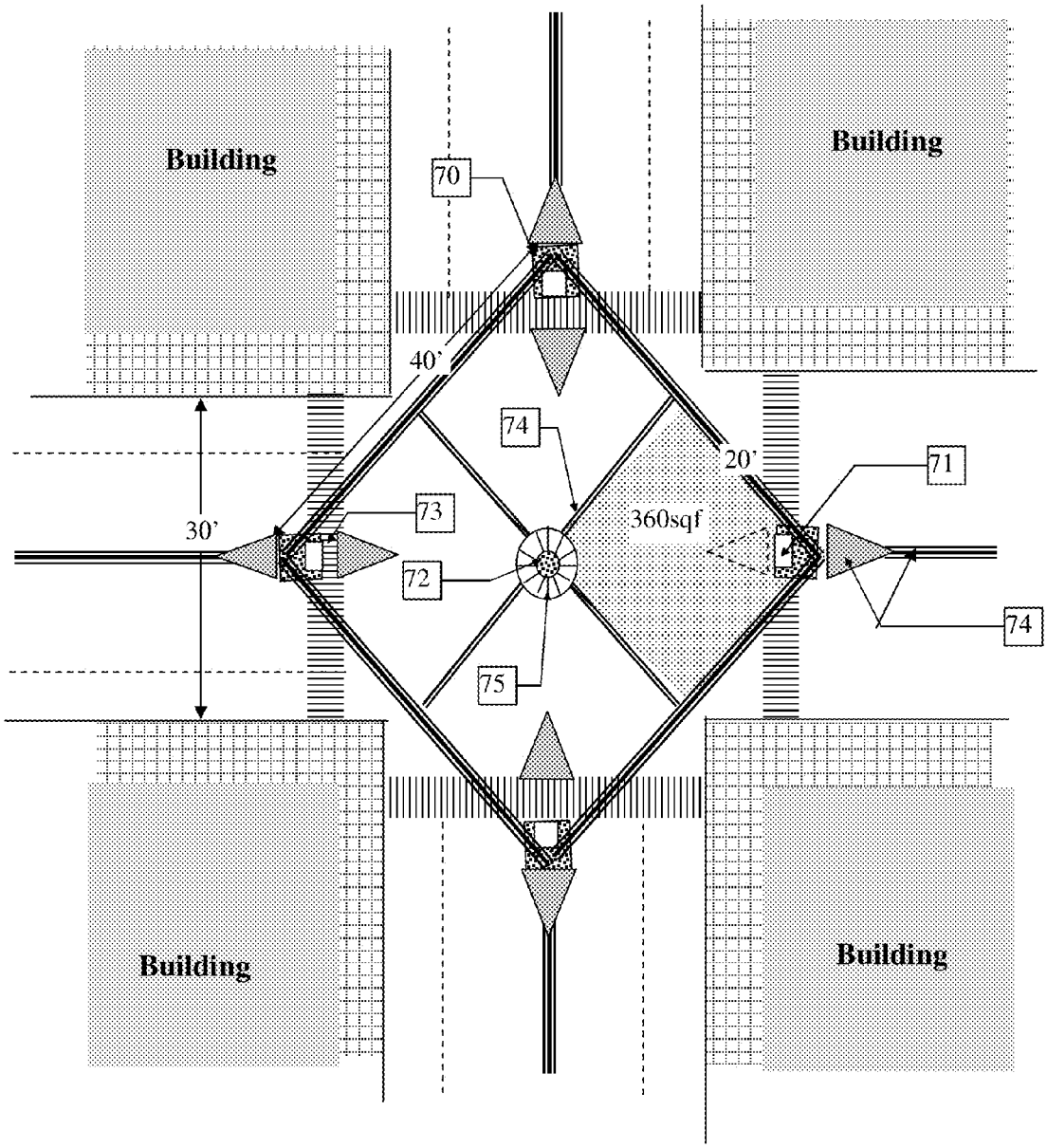
FIG. 8 illustrates a top view of a residential building erected on 4 column supports situated on the medians of intersecting streets and a column in the center of the intersection.

FIG. 8 illustrates a top view of a residential building erected on the air-space supported by 4 column 70 situated on the medians of intersecting streets and a column 72 in the center of the intersection around which are located the emergency downstairs and the water and sewage conduits. In this type of a building, access and exit is through the elevators 71 adjacent to the supports and accessible only through pedestrian crossings 73. Therefore the medians close to the pedestrian crossings have to be modified so that traffic in the adjacent lanes is moved away from the building supports and the adjacent elevators by proper physical barriers 74. Such buildings erected on the air-space at intersections of comparatively narrow streets may provide 4 dwellings having an area of 390 sq ft each for each floor.

Figure 9:
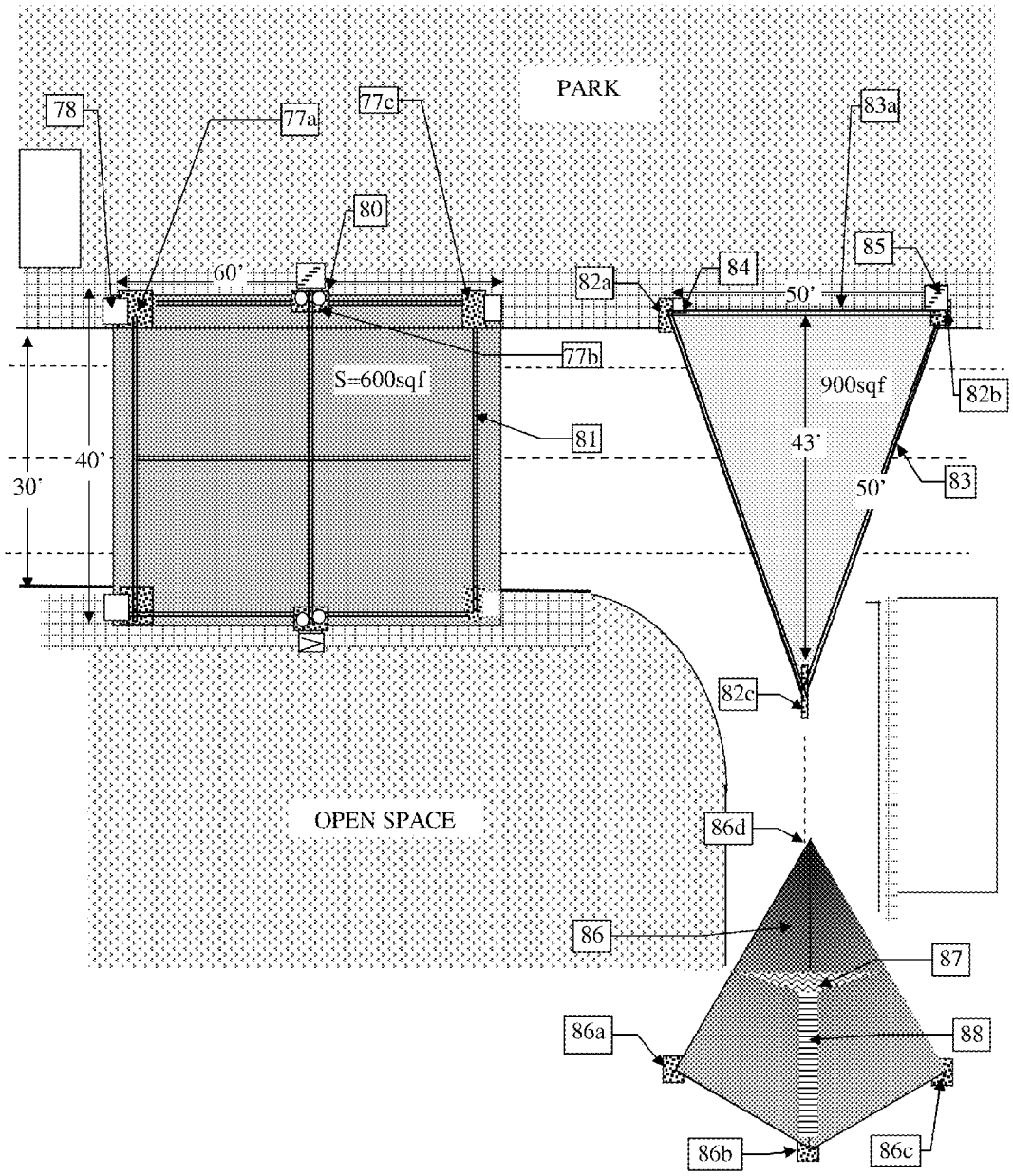
FIG. 9 illustrates a multi-storey residential building built on cornerstones on the opposite sidewalks of a 4-lane street.

FIG. 9 illustrates two multi-storey residential or office buildings erected on the air-space between the opposite sidewalks of a relatively narrow street where on both sides of the street are open spaces such as parks, without residential buildings. Thus such buildings do not hamper the view across the street to anyone.

One of the buildings is a rectangular 30' wide structure erected on 3 support columns 77*a*, 77*b* and 77*c* extending for a total span of 60', on each side of the street. The building is supported by 40' beams 81 extending from one side of the street to the other. The resulting 40×60=2400 sq ft floor area may be divided into four residences, each 600 sq ft large. Access to each apartment is through an elevator 78 adjacent to the cornerstone columns. Emergency stairs 79 are by the middle support column 77*b* that also contain the water and sewage installations 80.

The second building has a triangular shape; the base of the triangle is supported by two cornerstone foundation supports 82*a*, 82*b* on the sidewalk of the street and the apex is supported by a column 82*c* in the middle of an intersecting street, 45' away from the base. The triangular structure is held by long-span steel beams of 50' long at the base and 50' long between the base and the apex, laid on the steel reinforced concrete cornerstones, on each floor. Access to the various floors is by elevator 84 adjacent to the cornerstone column 82*a*. Emergency escalators 85 from each floor are by the cornerstone column 82*b* Each floor has a surface of 900 sq ft.

This figure also illustrates a pyramide-like structure 86 that may be erected on 3 cornerstone foundation supports 86*a*, 86*b*, 86*c*; inclined steel beams with one of their ends on the support columns, may be joined at their other ends at the apex of the pyramide 86*d*. The pyramid may have a second floor supported at half-beam points by a triangular girdle holding a triangular platform. Access to the second floor 87 may be by stairs 88 affixed to one of the beams.

FIG. 10 illustrates a 2 storey car garage built on 4 cornerstone foundation support columns 90 on each of the opposite sidewalks of a street 40' wide. The length of the illustrated parking garage is 120' and each side may accommodate 15 cars, leaving a 10' lane in the middle of the two parking rows. Access and descent to the first floor of the parking garage, is through the respective up ramps from one direction 89*a* and access and descent from the second floor is through the respective ramps from the other direction 89*b*. People descent is through stairs 89 behind the support columns.

As each floor of the parking garage may accommodate 30 cars, the parking garage may accommodate 60 cars. As the up and down ramps in practice block the two middle lanes of the street, they can also be used for additional parking of another 30 cars.

Figure 11:
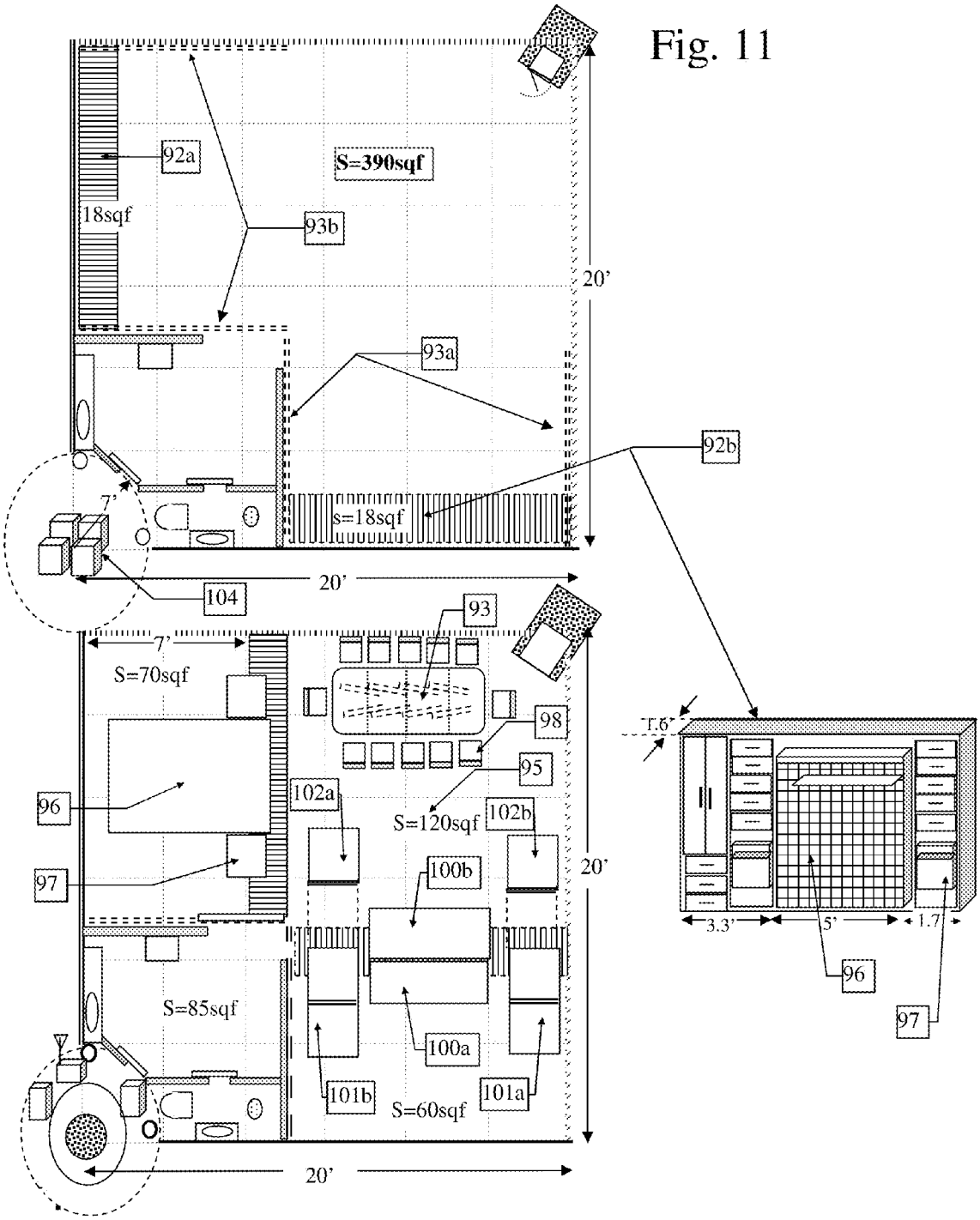
FIG. 11 illustrates a possible furnishing of a micro-apartment using folding furnitures stored in bookshelves-like fixtures that are on rails, that can be moved in parallel to the backwalls and thus form room-like closed spaces.

FIG. 11 illustrates a possible furnishing of a micro-apartment of 360 sq ft illustrated in FIG. 7, using folding furnitures stored in bookshelves-like fixtures 92*a*, 92*b* that are on rails 93*a*, 93*b* and can be moved in parallel to the backwalls, thus forming room-like closed spaces of 60 sq ft and 70 sq ft. A master folding bed 96 and two chests 97 may unfold out of one of the bookshelf-like fixtures thus forming a master bedroom, while out of the other bookshelf-like fixture two child beds 101*a*, 101*b* and a desk 100*a* may unfold. Out of the other side of the bookshelf-like fixture a couch 100*b* and two armchairs 102*a*, 102*b* may unfold for use in the 120 sq ft living room. Other collapsible furniture stored in the bookshelf-like fixture include a collapsible table 93 and chairs 98.

Figure 12:
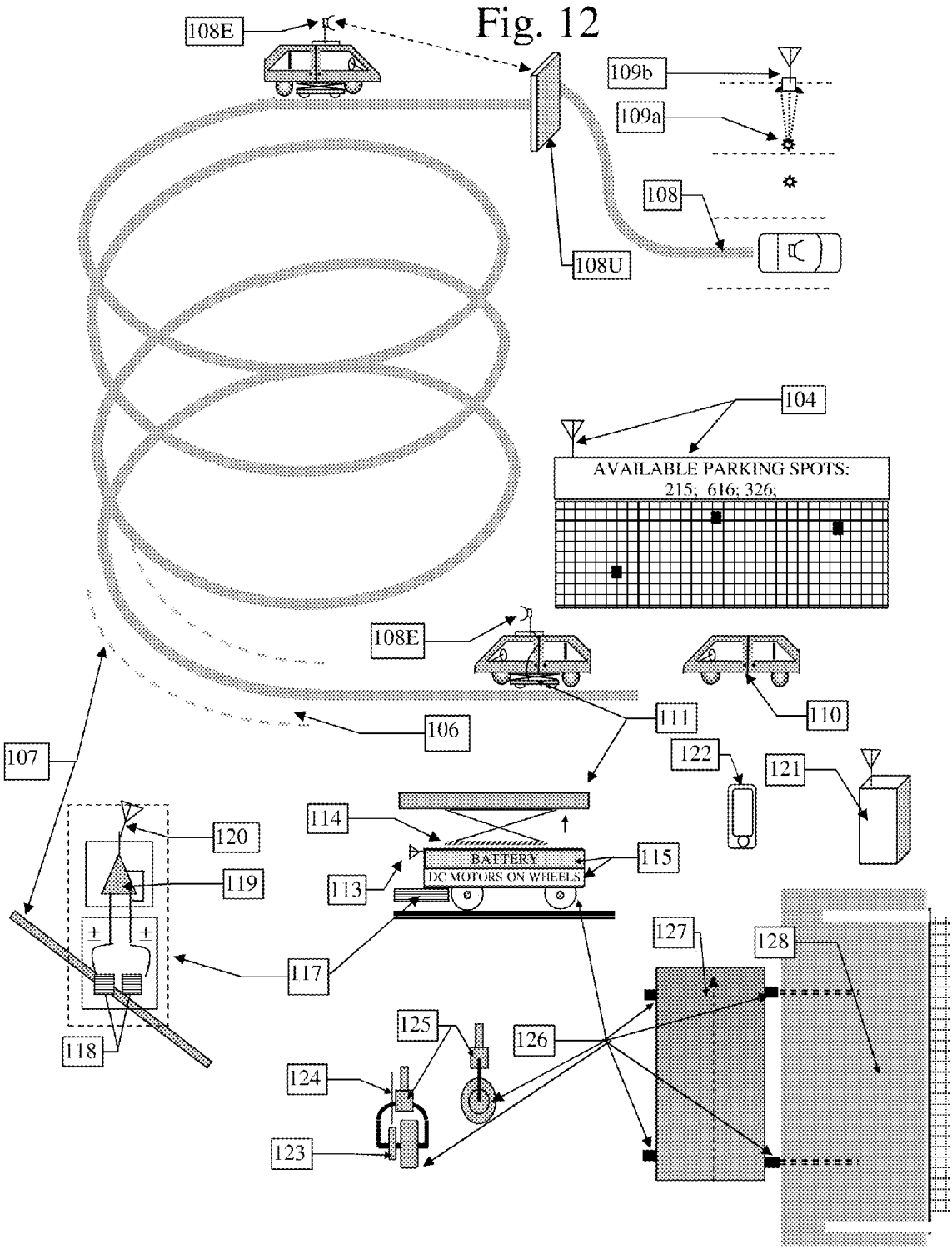
FIG. 12 illustrates a driverless autonomous vehicle that facilitates parking in elevated floors of a parking garage.

FIG. 12 illustrates the autonomous driverless parking feature that facilitates parking in elevated floors. While driving a floor or two or even three for parking a car is acceptable, driving 10 or 20 floors is not. Therefore autonomous, driverless parking is a must in multi-storey parking garages.

The status of any parking place, in the multi-storey garage is at all times monitored, for example by light beams between a light source 109*a* and a light sensor 109*b*, that indicate when the space between the two is blocked. This information is transferred by wireless to a central processor 121 that broadcasts this information on the internet and displays it visually on large displays 104 inside and outside the parking garage.

As the route 106 in the garage, from the base station where the car driver leaves his car, to a preassigned parking place 108 is well determined, the car may be brought to its parking place by a robotic platform 111 that follows the preassigned route. The robotic platform 111 is on sturdy wheels 126 and gets its instructions by wireless 113 from a central processor 121 through a remote controller which can be a smartphone 122 loaded with a specific application. When placed under the car, its hydraulic car jack like lever 114 may be activated to lift the car that may weigh up to 2 tons.

The energy E needed to lift the car for 10 floors, for example, taking in account 7' high parking garage floors, may be calculated by E=mgh where (m) is the weight of the car (2 tons) (g)=9.81 is the gravity constant and (h) height of the 10 floors. This calculation neglects the friction to be overcome while climbing the 10 floors.

$$mgh=[2.10^3(9.81)]\cdot[21\text{ meters}]\approx(4.2)10^4\text{ Joules}=42\text{ kw-second}$$

In terms of $LiFePo_4$ battery capacity that produces a voltage of 3.2V, in (Amp)(hour) terms, 1 Ah, (3.2) (3600)watt-sec=11.5 kW·sec.

Therefore the energy needed to move a 2 ton car for 10 floors is [(42)/(11.5)]=3.65 Ah An order of magnitude estimate for all other factors that consume energy, mainly friction and motor inefficiencies, may be obtained by comparison with the energy consumption of electric cars. An electric car uses on the average around 25 kWh for 100 miles. The length of the 10 floors route in the parking garage described in FIG. 3 is 10(πD)=1068'; adding a tour of the floor of πD=333' for parking the car and multiplying by 2 for the return trip, it comes to a total route of 2800' which is approximately ½$^{th}$ of a mile.

Therefore it approximately takes for an electric car less than 125 Wh or 40 Ah of $LiFePo_4$ batteries with a V=3.2V to run the 0.5 mile route. Adding to that the energy to lift the car of 3.65 Ah the total energy expended comes to approximately 44 Ah.

Thus a battery of 220 Ah having dimensions of 205*103*370 mm can support more than 5 parking tours up and down up to 10 floors, before requiring a recharge.

The robotic platform may travel at 10 miles/hr taking 3 minutes to travel the parking route of 1400' forth and back. Future Lithium Sulfure batteries that promise to have 4 times the capacity for the same energy will enable to reduce the size of the batteries in the trolley. The trolley uses more than 90% efficient DC motors 123 that determine speed, to control each of the 4 wheels 126 independently, thus enabling to steer and maneuver itself into narrow parking spaces accurately.

The wheels' axial positions are independently controlled by other electrical motors 125 that also receive their instructions by wireless from the central processor 121 through a controller that may be a smartphone. Thus for example when all 4 wheels are turned onto a direction perpendicular to the long axis of the platform 127, the trolley will move sideways, for example onto a parking place 128 by the sidewalk of the road.

The robotic platform carries a magnetic sensor 117 that senses deviation from a magnetic strip or wire laid on the middle of the ramps and the routes to the parking places in all the floors. Alternatively other technologies may be used to sense the middle of the route, for example a camera for detecting the position of a specific colored strip.

The route of the trolley may also be controlled by an inertial guidance system. Using MEMS sensors to measure velocity, accelerations and pressure as a function of time, enable to determine current position at all times and lead the trolley to the allocated parking place of the car.

When following a track, the deviation signal from the center of the track is processed and an appropriate correction signal is fed to the DC motors that control the 4 wheels, thus enabling to stay on course, reach the parking place and park the car. The robotic trolley may then lower the car onto its wheels and wait for further instructions. A video camera and an ultrasound emitter-sensor for distance measurement 112 is placed on top of the car for imaging the route to the parking place and watching any unforeseen situation from a control center manned by a human. The human controller can at all times stop the robotic platform and or assign it a route different than following the magnetic/colored strip, by giving its DC motors that control the routes the appropriate directions.

An optical camera with an ultrasound emitter/sensor 108E positioned on the car roof transmit images at all times during the route to the parking place. The ultrasound emitter/sensor measures distance from reflectors 108U pre-installed in the multi-storey garage at strategic places, for example at an exit of the ramp, and enable to transmit distances from such reflectors thus complementing the visual images.

There are multiple ways to realize the invention explained above, combine the differentiating features illustrated in the accompanying figures, and devise new embodiments of the method described, without departing from the scope and spirit of the present invention. Those skilled in the art will recognize that other embodiments and modifications are possible. While the invention has been described with respect to the preferred embodiments thereof, it will be understood by those skilled in the art that changes may be made in the above structures and in the foregoing sequences of operation without departing substantially from the scope and spirit of the invention. All such changes, combinations, modifications and variations are intended to be included herein within the scope of the present invention, as defined by the claims. It is accordingly intended that all matter contained in the above description or shown in the accompanying figures be interpreted as illustrative rather than in a limiting sense.

I claim:

1. A multi-story structure extending on an air space over an intersection formed by two intersecting traffic roadway;

wherein each roadway intersection comprising at least four lanes, at least two of the lanes leading to ramps extending from and into the multi-story structure, and at least two pass-through opposing traffic lanes under the multi-story structure with a roundabout structure located in the middle of said intersection; and the multi-story structure comprising four cornerstone foundations such that the structure is erected on four cornerstone support columns connected to said four cornerstone foundations;

each cornerstone support column and foundation located on an intersection of two adjacent sidewalks bordering the outermost lanes of two adjacent roadway of said intersecting traffic roadway, wherein said four cornerstone support columns are interlinked by one of reinforced concrete layer and steel beams positioned under said roadway;

and the roundabout structure further comprising a central support column supporting and connected to the middle of the multi-story structure.

2. A multi-story structure extending on an air space over an intersection formed by two intersecting traffic roadway as in claim 1, further comprising medians located before the intersection for separating said opposing traffic lanes.

3. A multi-story structure extending on an air space over an intersection formed by two intersecting traffic roadway as in claim 2, wherein each of said four cornerstone support columns comprising elevators for accessing each floor of the multi-story structure, each elevator located within the cornerstone support column on the sidewalk having an entrance from said sidewalk.

4. A multi-story structure extending on an air space over an intersection formed by two intersecting traffic roadway as in claim 1, wherein the multi-story structure includes a parking garage, a commercial space and a residential space.

5. A multi-story structure extending on an air space over an intersection formed by two intersecting traffic roadway as in claim 4, wherein the multi-story structure further comprising at least two lower floors exclusively for parking vehicles, at least two floors directly above said parking garage floor exclusively for commercial use, and at least two uppermost floor exclusively for residential occupancy.

6. A multi-story structure extending on an air space over an intersection formed by two intersecting traffic roadway as in claim 5, wherein each of said ramps adapted for entering and exiting the multi-story structure are spiraling ramps leading directly to each of the at least two parking garage floors.

* * * * *